United States Patent [19]

Wood

[11] 4,451,240

[45] * May 29, 1984

[54] AQUATIC MAT

[75] Inventor: Robert L. Wood, Wichita Falls, Tex.

[73] Assignee: Advanced Sports Corp., Wichita Falls, Tex.

[ * ] Notice: The portion of the term of this patent subsequent to Feb. 13, 1996 has been disclaimed.

[21] Appl. No.: 267,285

[22] Filed: May 27, 1981

Related U.S. Application Data

[60] Continuation-in-part of Ser. No. 10,201, Feb. 8, 1979, abandoned, which is a continuation-in-part of Ser. No. 743,340, Nov. 19, 1976, Pat. No. 4,138,753, which is a division of Ser. No. 609,049, Aug. 29, 1975, Pat. No. 4,006,503, which is a continuation-in-part of Ser. No. 594,018, Jul. 8, 1975, abandoned.

[51] Int. Cl.[3] ..... B63B 35/72

[52] U.S. Cl. ..... 441/129; 5/481

[58] Field of Search ..... 5/417, 419, 448, 450, 5/473, 481; D21/237; 441/35, 44, 45, 46, 55, 74, 129

[56] References Cited

U.S. PATENT DOCUMENTS

| | | | |
|---|---|---|---|
| D. 224,138 | 7/1972 | Mahler | D6/209 |
| 1,723,473 | 8/1929 | Erickson | 9/310 E |
| 2,167,178 | 7/1939 | Kohlstadt | 5/481 |
| 3,369,262 | 2/1968 | Judd | 5/481 |
| 3,400,415 | 9/1968 | Scheurer | 9/342 |
| 3,512,190 | 5/1970 | Buff | 5/481 |
| 3,623,170 | 11/1971 | Staley | 5/463 |
| 3,639,927 | 2/1972 | Munch | 5/481 |
| 4,006,503 | 2/1977 | Wood | 441/129 |
| 4,138,753 | 2/1979 | Wood | 9/13 |
| 4,149,919 | 4/1979 | Lea | 9/13 |

FOREIGN PATENT DOCUMENTS

| | | | |
|---|---|---|---|
| 601681 | 7/1960 | Canada | 5/481 |
| 1073169 | 1/1960 | Fed. Rep. of Germany | 9/13 |
| 1145971 | 3/1969 | United Kingdom | 9/13 |

OTHER PUBLICATIONS

"Get Set for a Safe Boating Season with Ensolite", U.S. Rubber, *Rudder,* May 1964, p. 47.

*Primary Examiner*—Sherman D. Basinger
*Attorney, Agent, or Firm*—James Creighton Wray

[57] ABSTRACT

A buoyant, flexible, resilient aquatic mat for use on water surfaces adapted to support one or more persons. The mat comprises an elongated slab and a headrest formed of the same material. The material of the mat comprises a unicellular, non-water absorbent, plastic foam. The material comprising the mat may have a tough plastic coating over the entire surface or by use of a suitable plastic foam material the material comprising the mat may be used without a coating. A series of parallel grooves with rounded inner surfaces extends into the mat from its lower surface. The grooves formed with heated rounded bars to provide density increased skin surfaces in areas of the grooves.

31 Claims, 13 Drawing Figures

AQUATIC MAT

DESCRIPTION

BACKGROUND OF THE INVENTION

This application is a continuation-in-part of application Ser. No. 10,201 filed Feb. 8, 1979, now abandoned, which in turn was a continuation-in-part of application Ser. No. 743,340 filed Nov. 19, 1976, now U.S. Pat. No. 4,138,753, which in turn was a division of application Ser. No. 609,049, filed Aug. 29, 1975, now U.S. Pat. No. 4,006,503 which was a continuation-in-part of application Ser. No. 594,018, filed July 8, 1975, now abandoned.

This invention relates to an aquatic floatation mat or cushion providing sufficient buoyancy to permit a person to lie on the mat in water.

Aquatic mats now used for recreation and sports purposes are generally of the inflatable type. Although the inflatable types are satisfactory, they require the task of inflating them prior to use and deflating them after use. Furthermore, inflatable types can easily be punctured, ripped or torn. This will require patching, and if the tear or rip is large enough and cannot be patched, will render the mat useless.

The floation mat of the present invention constitutes an improvement over inflatable mats by eliminating the requirement for inflation and also eliminating the problem of punctures, rips and tears.

Aquatic mats may be made of a flexible material which is rollable for transportation storage, but such flexible material may not be durable or may be expensive or may be subject to deterioration. Less expensive relatively rigid and durable material has been incapable of convenient rolling or transportation and storage.

SUMMARY OF THE INVENTION

An object of the present invention is to provide a relatively rigid aquatic mat with regular transverse grooves with enhanced roughness for rolling.

It is an object of this invention to provide a novel aquatic mat with a headrest having a simplified construction, which is capable of floating on water, and which can support one or more persons.

It is another object of this invention to provide a novel aquatic mat having a headrest wherein the entire mat is manufactured from buoyant flexible, resilient slab materials.

Another object of this invention is to provide a novel buoyant, aquatic mat having a headrest for supporting a person's head containing one or more transverse open voids, which provide additional buoyancy to the headrest.

A further object of this invention is to provide a novel buoyant aquatic mat having a headrest containing an enclosed chamber or chambers wherein the bottom of the headrest chamber has vent holes for providing equalization of pressure in the chamber and for providing additional buoyancy to the headrest.

Generally the buoyant aquatic mat comprises an elongated, flexible, resilient, planar slab member and a headrest member containing a transverse void formed from the same material as the planar slab member. The slab material comprises a unicellular, non-water absorbent plastic foam. The material comprising the mat may have a tough plastic coating over the entire surface or by use of a suitable plastic foam material, the material comprising the mat may be used without a coating. Several embodiments of the mat are described. Furthermore, a modification adaptable to all the embodiments of the mat comprises slab material enclosing the ends of the void of the headrest forming an air chamber. An additional modification of the headrest with enclosed chambers is the provision of vent holes disposed through the bottom of the headrest communicating with the air chamber.

Other features and advantages of the various embodiments of the aquatic mat of the invention will become apparent from the following description of specific embodiments thereof taken in conjunction with the drawings.

DETAILED DESCRIPTION OF THE INVENTION

Figure 1:
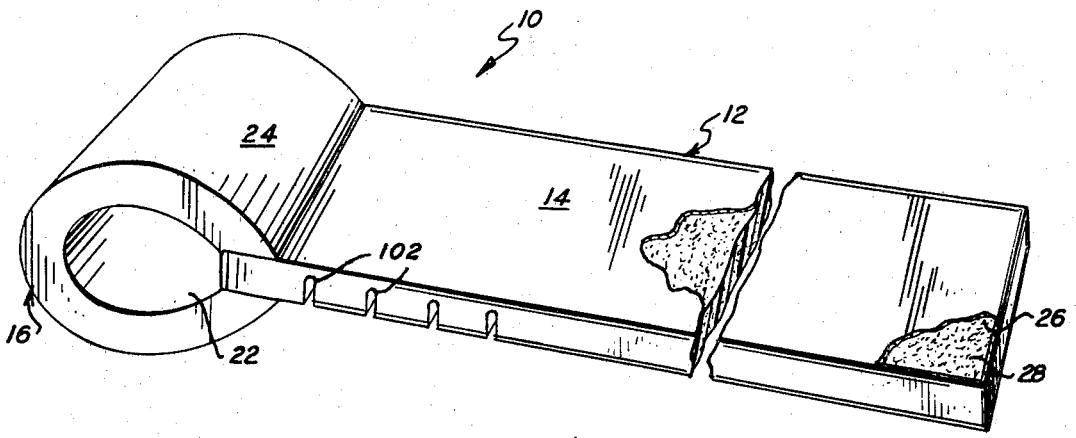
FIG. 1 is a perspective view of one embodiment of the aquatic mat of this invention.
Figure 2:
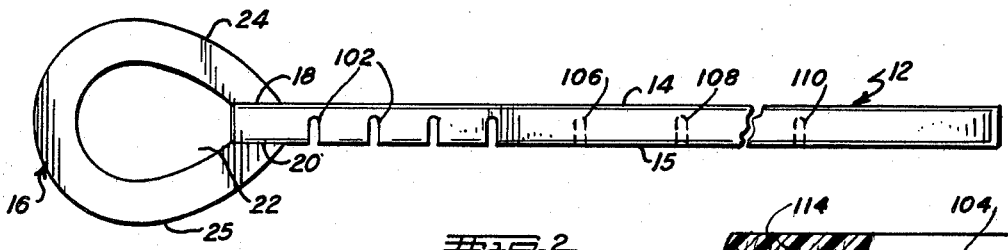
FIG. 2 is a side elevational view of the aquatic mat shown in FIG. 1.
Figure 3:
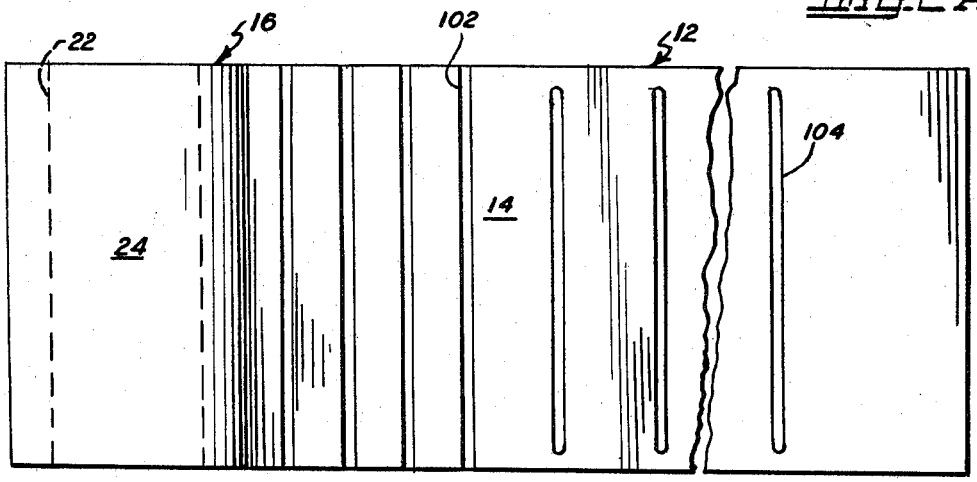
FIG. 3 is a bottom view of the aquatic mat shown in FIG. 1.

Referring to FIGS. 1–3 of the drawings, the numeral 10 in FIG. 1 generally denotes a first embodiment of the aquatic mat of the invention. The mat 10 comprises an elongated slab generally denoted by the numeral 12, having planar surfaces 14 and 15, a generally rectangular shape, and a suitable thickness of one to three inches or more. Although a rectangular shape is shown, it is contemplated within the scope of the invention that other geometric shapes can be used such as circular, ovate, polygonal, etc. The slab is of a sufficient surface area, i.e., length and width, to accommodate a person or persons lying prostrate on one of its surfaces 14 or 15.

The slab is constructed or molded from a suitable, flexible, resilient material 28, which is non-water absorbent, such as plastic foam or the like. Particularly, the plastic foam is a unicellular, flexible, plastic foam, i.e., a foam having closed cells, such as plastic foams produced from polyvinylchloride, and the like. The plastic foam material is relatively firm, but at the same time has buoyancy in water, resiliency and flexibility for supporting a person. An example of a suitable plastic foam material, although numerous closed cell plastic foams are suitable, is a relatively stiff material which forms a self skin or which may be made to form a self skin on application of heat with or without pressure and which can be used without any surface treatment, such as coating, or may be coated to provide decorative properties. Such surface coating or casing 26, preferably smooth, covers the entire resilient material throughout all its surfaces and is a tough, pliable, tear resistant material of a suitable plastic material, or the like. The coating is preferably applied on the surfaces of the resilient material by spraying, dipping or by any other suitable means, whereby the coating adheres tenaciously to the surfaces. Plastic materials are preferred for the coating, since there are available on the market many tough, rugged, pliable plastic coating materials such as polyvinylchloride etc. Hereinafter, all the materials used in the construction of the aquatic mats are of the type described above.

Mat 10 also comprises a headrest member generally denoted by the numeral 16 which is of the same slab material as slab 12. Headrest 16 is a plastic slab, the ends of which are bonded to one end of slab 12 at 18 and 20. In the preferred construction of the mat, plastic coated foam slabs 12 and 16 are bonded together as shown. The slab 16 is bonded first at 18 then curved around the end of slab 12, and bonded at 20. Alternatively, the mat can be constructed from non-plastic coated slabs by bonding the ends of slab 16 similarly to the end of slab 12. The constructed mat can be used without further surface treatment of the mat materials or the entire constructed mat can be dipped in or coated with a plastic coating.

The headrest 16 of mat 10 comprises headrest surfaces 24 and 25 upon which a person's head can rest. Thus, the embodiment 10 can be used on either side 14 or 15. A transverse void 22 in the headrest is open at both ends and provides a certain amount of buoyancy to the headrest area. The entire mat is adapted to float on a surface of water and is designed to support the weight of one or more persons, depending on its size.

Figure 4:
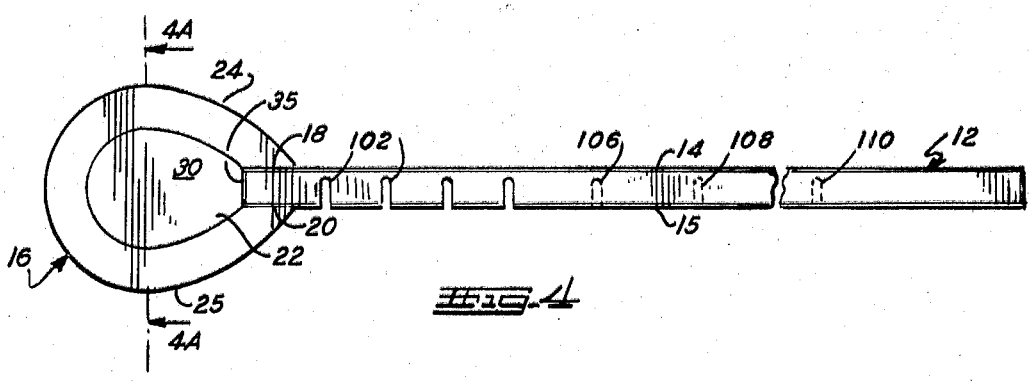
FIG. 4 is a side elevational view of a modification of the aquatic mat embodiment shown in FIG. 1.
Figure 4A:
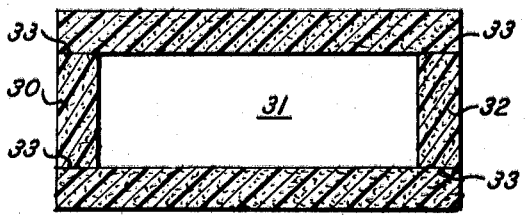
FIG. 4A is a section taken along line 4A—4A of FIG. 4.

In FIGS. 4 and 4A there is shown a modification of the aquatic mat of FIGS. 1–3. In the modification, generally ovate or round end members 30 and 32, formed from the coated or uncoated slab material, are inserted and bonded in the end sections of the transverse void 22 of the headrest 16 forming an enclosed chamber 31 (not shown in FIG. 4). The bonding is shown at 33 between the inner end surfaces of the headrest and the edges of the end members 30 and 31. In addition, each end member 30 and 32 is bonded to the edge of slab 12 and 35 as shown with member 30 in FIG. 4. With the end members bonded in each end of the headrest, an airtight and leadproof chamber 31 is provided. The closing of the transverse void to form an enclosed chamber provides additional buoyancy to the headrest.

Figure 5:
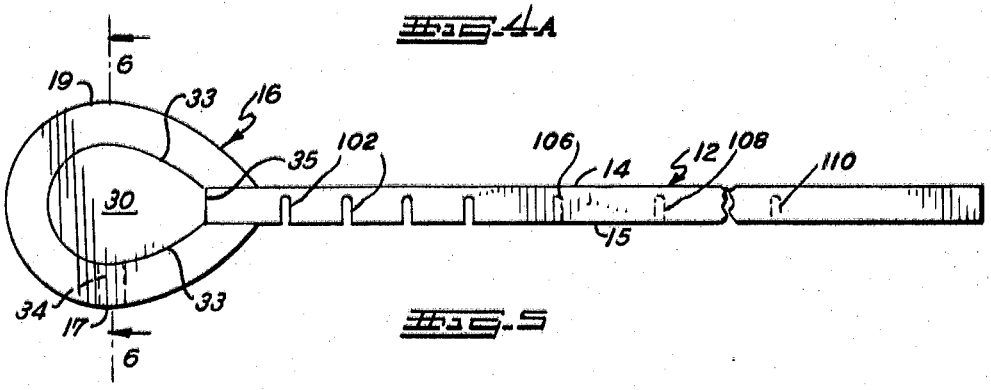
FIG. 5 is a side elevational view of a further modification of the aquatic mat embodiment shown in FIG. 4.
Figure 6:
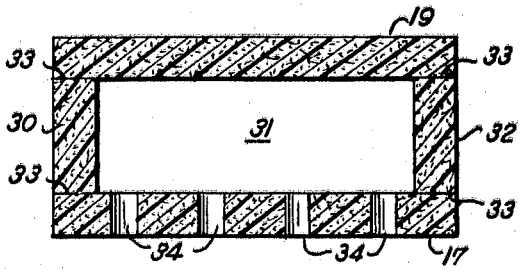
FIG. 6 is a section taken along line 6—6 of FIG. 5.

Referring now to FIGS. 5 and 6, there is shown a further modification of the mat containing an enclosed chamber as shown in FIG. 4. In this modification, the mat 10 is used with the surface 15 as the bottom and surface 14 as the top. The headrest 16 comprises a top portion 19 and bottom portion 17. A series of vent holes 34, up to about two inches in diameter, are disposed across and through the bottom portion 17 which communicates with the chamber 31. Holes 34 provide an equalization of pressures within the chamber 31 and ambient pressures, which change with temperature changes. Holes 31 provide additional buoyancy and structure to the headrest 16 when floating on water, i.e., the holes in contact with a water surface tend to retain air as an air pocket in chamber 31, and generally release of the air from the chamber due to pressure on surface 19 from a person's head is prevented. It is understood that in the modification of mat 10 wherein an enclosed chamber is provided in the headrest of the mat, that the mat 10 can be used without the holes provided in the second modification. However, the modification provided with holes requires the use of a mat headrest with an enclosed chamber. Although the modification of the enclosure of the headrest void with end members, and the further modification for provision of holes is shown with the mat embodiment 10, it is understood that these modifications are applicable to other embodiments of the mat to be described hereinafter.

Figure 7:
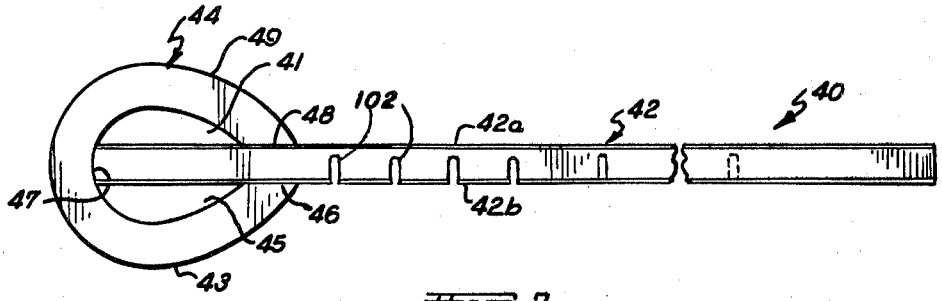
FIG. 7 is a side elevational view of a second embodiment of the aquatic mat of this invention.

In FIG. 7, a second embodiment 40 of the mat is shown, wherein a slab 42 has planar surfaces **42*a* and 42*b*. Headrest 44 had headrest surfaces 43 and 49. In this embodiment, the mat is constructed by bonding the slab 42 to the ends of the headrest at surfaces 46 and 48 and bonding the end of the slab 42 to inner surface 47 of the headrest, thus forming transverse voids 41 and 45. This embodiment provides additional structure to the headrest and can be used on either surface 42*a* and 42*b***.

Figure 8:
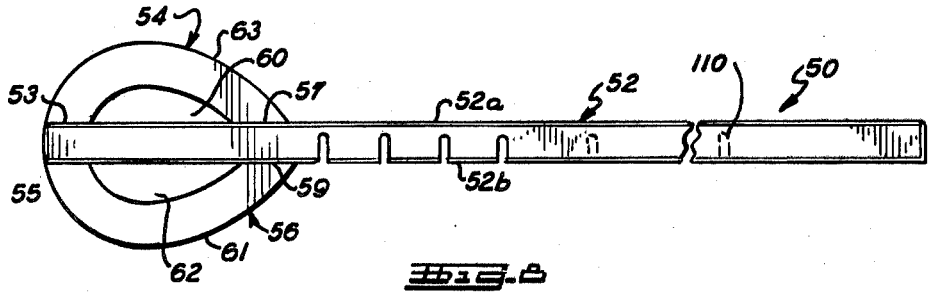
FIG. 8 is a side elevational view of a third embodiment of the aquatic mat of this invention.

In FIG. 8, a third embodiment 50 of the mat is shown, wherein a slab 52 has planar surfaces **52*a* and 52*b*. Headrests 54 and 56 are formed from separate slabs which are bonded to the respective ends of slab 52. Headrest 54 has headrest surface 63 and is bonded to surface 52*a* at 53 and 57 forming a void 60. Similarly, headrest 56 has surface 61 and is bonded to surface 52*b* at 55 and 59 forming a transverse void 62. The embodiment provides additional structure to the headrest area and can be used on either surface 52*a* or 52*b***.

Figure 9:
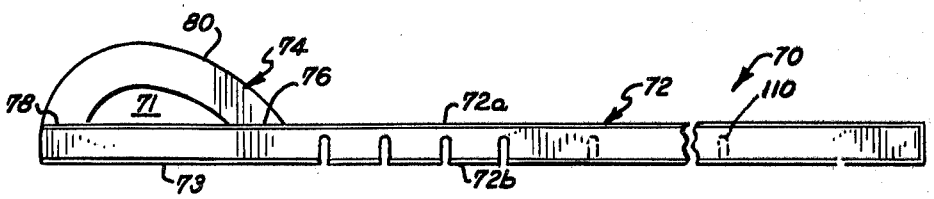
FIG. 9 is a side elevational view of a fourth embodiment of the aquatic mat of this invention.

In FIG. 9 a fourth embodiment 70 of the mat is shown, wherein a slab 72 has a top planar surface **72*a* and bottom planar surface 72*b*. A single headrest 74 has headrest surface 80 and the end of surface 72*a* and slab 72 is bonded to the headrest ends at 76 and 78 forming a transverse void 71**.

Figure 10:
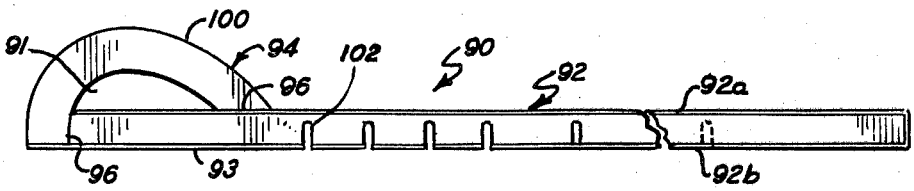
FIG. 10 is a side elevational view of a fifth embodiment of the aquatic mat of this invention.

In FIG. 10, a fifth embodiment 90 of the mat is shown, wherein a slab 92 has a top planar surface **92*a* and bottom planar surface 92*b*. A single headrest 94 has headrest surface 100 and the end of surface 92*a* of slab 92 is bonded to the headrest end area at 96 and the other end of the headrest is bonded to surface 92*a* at 96 forming a transverse void 91**.

In FIG. 1 the mat 10 is shown with the elongated planar member 12 having grooves 102 so as to enable the device of this invention to be easily rolled up.

Figure 11:
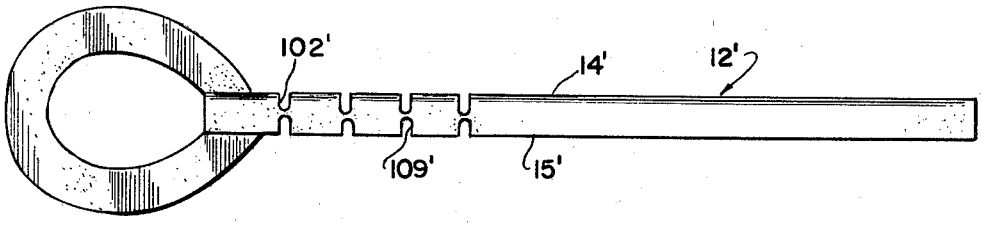
FIG. 11 is a side elevational view of a modification of the aquatic mat shown in FIG. 2.

The grooves 102 are placed one one side of the elongated planar member with said grooves spaced so as to enable easy rolling of the mat. These grooves are preferably every six to ten inches on the elongated planar member and run transversely, although a single groove may be provided. As shown in FIG. 11 grooves 102' may be formed on both respective planar surfaces 14' and 15' of the elongated planar member, equidistant into the elongated planar member 12', and are placed so that the grooves on each respective planar surface oppose a groove on the opposing respective planar surface. The above described grooving of the elongated planar member is equally applicable to embodiments 10, 40, 50, 70 and 90.

Grooves may extend up to two-thirds through the thickness of the mat, as shown at 104. Grooves of varied depth, for example, two-thirds, one-half and one-third of the thickness of the mat may be provided to balance the desired resilience and rollability of the mat.

Figure 2A:
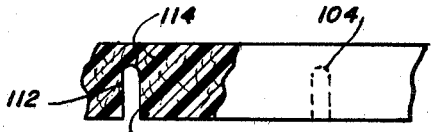
FIG. 2A is a detailed view of the aquatic mat.

Grooves 102 shown in FIGS. 1–4 extended from edge to edge and are of uniform spacing. Grooves 104 shown in FIGS. 2A–4 terminate short of the edges. Grooves 106, 108 and 110 shown in FIG. 2 have varied spacing and depths related to distances from one end. As shown in FIG. 2A grooves have dense self skin 112 which may be relatively thick and strong at radius 114.

Grooves may be varied in depth, interval and length according to radius requirements in rolling. For example, grooves may be deep or relatively close together near the head end to provide maximum flexture and radiusing when bending the mat for rolling. Grooves nearer the middle or foot end of the mat may be spaced farther apart or may be less deep or both since the radius of bending increases as the mat is rolled from the head end toward the foot end around the head end pillow.

Alternatively, in one embodiment the grooves may be relatively deep or closely spaced or both at the foot end so rolling can begin there. That embodiment provides added support against bending in the shoulder area to stiffen the mat and augment buoyance there.

The pillow part may be grooved for comfort in use and to promote flatening when rolling, especially from the foot end.

In preferred embodiments the grooves extended up to two-thirds of a thickness into the mat. The depth may be varied from groove to groove or within each groove.

In one embodiment the groove depth is reduced in the middle of the mat, and groove depth is increased near lateral edges of the mat. That provides greater resistance to curvature towards the center of the mat where supported weight is usually heaviest and provides greater flexibility near the edges of the mat which may be desirable in use and which may provide further resistance to tearing upon rolling.

Alternatively, the grooves stop short of lateral edges of the mat as shown at 104. This allows the mat central flexibility and slight dislining for stability while allowing the mat to be rolled. In this embodiment, the groove may be of uniform depth, or depth may increase toward the center or may taper uniformly, parabolically, or exponentially from the outer ends of the groove.

Grooves are formed in a preferred way by a heated curve rod or bar stock. Bottoms of grooves are formed with a uniformly curved radius, and the entire groove has a heat formed skin which may be enhanced in strength and/or thickness in the area of the bottom radius. In one embodiment, the heated rod is pushed into the mat to form the material, material builds up at the bottom radius increasing strength in that area.

The grooves of the present invention allow a less expensive, more rigid material to be used than the Uniroyal "ENSOLITE". The grooves permit the less expensive and more rigid and resilient material to be rolled for carrying or storage. At the same time, sufficient material remains adjacent the groove to maintain resilience so that the aquatic floatation mat returns to its original shape. Preferably, at least one-third of a thickness of the mat remains adjacent the groove to maintain resilience and strength while permitting rolling. Grooves are from one-third to two-thirds as deep as the thickness of the planar member. In a preferred embodiment, the groove is about half as deep as a thickness of the planar member. That permits resilience and strength while permitting the mat to be rolled. When opposed grooves are employed, one-third of the mat thickness remains undisturbed between the grooves.

The grooves are formed and spaced so that the mat retains its lateral stability and tends to retain its longitudinal stability while providing buoyancy and floatation for heavier parts of a body of a person using the mat. The grooves are spaced at intervals of preferably about 6 to about 10 or about 18 inches. Intervals of about one foot are preferred between grooves. An aquatic floatation mat uniquely results in which relatively more resilient or rigid sections about one foot in dimension along the longitudinal dimension of the mat are joined by integrally formed resilient sections which are less resilient and more bendable than the ungrooved parts.

The resulting device uniquely supports parts of the body with desired floatation, strength, and resistance to unwanted deformation while permitting rolling of the mat for storing and carrying.

It is understood that the concept of the first modification shown in FIGS. 4 and 4A with respect to the provision of a closed airtight chamber as used with embodiment 10, is also application with embodiments 40, 50, 70 and 90. Thus, in embodiment 40 of FIG. 7, end members can be bonded in both sides of transverse voids 41 and 45 to provide two airtight chambers; in embodiment 50 if FIG. 8, end members can be bonded in both sides of transverse voids 60 and 62 to provide two airtight chambers; in embodiment 70 of FIG. 9, end members can be bonded in both sides of transverse void 71 to provide a single airtight chamber; and in embodiment 90 of FIG. 10, end members can be bonded in both sides of transverse void 91 to provide a single airtight chamber.

Similarly, it is understood that the concept of the second modification shown in FIGS. 5 and 6, with respect to the provision of a series of vent holes as used with the embodiment 10 as modified with an airtight chamber in FIG. 4, is also applicable with embodiments 40, 50, 70 and 90. In each of these embodiments as modified with airtight chambers, a series of vent holes can be provided along the bottom of the headrest. Thus, in embodiment 40, the series of vent holes are disposed through headrest surface 43; and in embodiment 50, the vent holes are disposed through headrest surface 61. In embodiments 70 and 90, the vent holes are disposed through portion 73 of slab 72 and through portion 93 of slab 92, respectively. When the vent holes are provided, all the mat embodiments are used with the surface containing the vent holes on the surface of water.

From the above description of the aquatic floatable, mat of the invention, it is clear that a novel mat is provided for use in water sports, leisure, etc. The optional coating or casing 26 provides a surface which is smooth and protects the plastic foam 28 within. However, even if the coating 26 is damaged, ripped or torn, etc., the buoyancy of the mat is not diminished, because of the use of non-water absorbent closed-cell type plastic foam. Although the mat has particular adaptability for use on water surfaces, it is understood that the mat can also be used on solid surfaces and also on uneven surfaces, such as sand beaches, to which the bottom of the mat will conform.

From the foregoing description, one skilled in the art can easily ascertain the essential characteristics of this invention, and without departing from the spirit and scope thereof, can make various changes and modifications of the invention to adapt it to various usages and conditions.

I claim:

1. An aquatic floatation mat capable of floating in water and supporting one or more persons, comprising an elongated planar member having top and bottom planar surfaces and a headrest secured to and extending from an end portion of said planar member; said planar member and said headrest formed from closed cell plastic foam slab members, which are flexible, resilient and non-water absorbent; said headrest slab member having ends thereof secured to an end portion of said planar member, said elongated planar member having transverse grooves formed in the elongated planar member; said grooves being spaced so as to enable the aquatic mat to be easily rolled up.

2. The aquatic mat of claim 1 wherein said grooves extend from about one-third to about two-thirds through a thickness of the planar member.

3. The aquatic mat of claim 1 wherein the headrest is curved around an end portion of said planar member, the ends of said headrest are secured to the top and bottom planar surfaces at an intermediate portion near the said end portion of said planar member, and the end edge of said planar member is secured to an inner surface of said curved headrest slab member thereby forming two transverse voids, wherein one void is above said top planar surface and one void is below said bottom planar surface of said planar member.

4. The aquatic mat of claim 1 wherein the plastic foam material has a surface coating of a tough pliable, plastic material.

5. The aquatic mat of claim 4, wherein said plastic coating material is firmly adherent to said plastic foam.

6. The aquatic mat of claim 4, wherein said plastic coating is a sprayed coating.

7. The aquatic mat of claim 4, wherein said plastic coating is a dipped coating.

8. The aquatic mat of claim 1 wherein said headrest comprises a curved slab member on each said top and bottom planar surface at said end portion of said planar member, one end of each said respective slab member secured to the said end portion of said respective planar surface and the other end of each said respective slab member secured to an intermediate portion of said respective planar surface near said end portion thereby forming two transverse voids, wherein one void is above and one void is below said planar member.

9. The aquatic mat of claim 1 wherein said headrest comprises one curved slab member on said top planar surface of said planar member, one end of said slab member secured to the end portion of said top planar surface and the other end secured to an intermediate portion of said top planar surface near said end portion thereby forming one transverse void above said top planar surface.

10. The aquatic mat of claim 9, wherein said headrest comprises end members enclosing said transverse void to form an air chamber, and vent holes disposed through said planar member communicating with said air chamber.

11. The aquatic mat of claim 1 wherein said headrest comprises one curved slab member on said top planar surface of said planar member, one end of said slab member secured to the end edge of said planar member and the other end secured to an intermediate portion of said top planar surface near said end portion thereby forming one transverse void above said top planar surface.

12. The aquatic mat of claim 1 wherein said plastic foam is produced from polyvinylchloride.

13. The aquatic mat of claim 1 wherein said headrest comprises end members enclosing transverse voids to form an air chamber.

14. The aquatic mat of claim 13, wherein said headrest has an enclosed transverse void disposed below the bottom planar surface and vent holes provided in the bottom portion of said headrest communicate with said enclosed void.

15. The aquatic mat of claim 1, wherein said transverse grooves are provided by placing grooves on one planar surface of said elongated planar member.

16. The aquatic mat of claim 15, wherein one groove is provided equidistant from the ends of the elongated planar member.

17. The aquatic mat of claim 1, wherein said transverse grooves are provided by placing grooves on both respective planar surfaces of said elongated planar member equidistant into said respective planar surfaces.

18. The aquatic mat of claim 17, wherein two transverse grooves are provided by placing one groove in each planar surface of the elongated planar member equidistant from the ends of the elongated planar member; said grooves being equidistant into said respective planar surfaces and opposed.

19. The aquatic mat of claim 1, wherein the grooves are of varied depth.

20. The aquatic mat of claim 1, wherein the grooves extend about half-way through a thickness of the planar member.

21. The aquatic mat of claim 1, wherein the grooves extend about one-third of the way through the thickness.

22. The apparatus of claim 1, wherein about one-third of a thickness of the planar member remains ungrooved.

23. The aquatic mat of claim 1, wherein the grooves are spaced at intervals of from about 6 to about 18 inches along the planer member.

24. The aquatic mat of claim 1, wherein the grooves are spaced at intervals of about 1 foot along the planar member.

25. The apparatus of claim 1 wherein the grooves extend between lateral edges of the mat.

26. The apparatus of claim 1 wherein the grooves terminate short of lateral edges of the mat.

27. The apparatus of claim 1 wherein at least one groove has varied depth.

28. The apparatus of claim 1 wherein grooves are spaced evenly along the mat.

29. The apparatus of claim 1 wherein grooves are spaced in increasing intervals from one longitudinal end portion of the mat to another longitudinal end portion.

30. The apparatus of claim 1 wherein grooves have varying depth.

31. The apparatus of claim 1 wherein grooves have depths which vary according to displacement from one longitudinal end of the mat.

* * * * *